US006252408B1

(12) United States Patent
Poole

(10) Patent No.: US 6,252,408 B1
(45) Date of Patent: Jun. 26, 2001

(54) RESISTANCE-MONITORING ARRANGEMENT

(75) Inventor: Damian Mounsey Poole, deceased, late of Altrincham (GB), by Katharine Lake Cumberledge, personal representative

(73) Assignee: Alstom UK Limited (GB)

( * ) Notice: Subject to any disclaimer, the term of this patent is extended or adjusted under 35 U.S.C. 154(b) by 0 days.

(21) Appl. No.: 09/298,038

(22) Filed: Apr. 22, 1999

(30) Foreign Application Priority Data

Apr. 22, 1998 (GB) ..... 9808496

(51) Int. Cl.[7] ..... G01R 31/08
(52) U.S. Cl. ..... 324/525
(58) Field of Search ..... 324/525, 526, 324/623, 697, 699, 700, 706, 71.1; 238/153, 159, 226, 227, 152

(56) References Cited

U.S. PATENT DOCUMENTS 3,593,919 7/1971 Hamilton, Jr. .
3,727,838 * 4/1973 Bergh ..... 238/153
4,466,570 8/1984 Howard .
4,773,590 * 9/1988 Dash et al. ..... 238/153
5,045,787 9/1991 Auer, Jr. et al. .

* cited by examiner

*Primary Examiner*—Safet Metjahic
*Assistant Examiner*—E P LeRoux
(74) *Attorney, Agent, or Firm*—Kirtschstein, et al.

(57) ABSTRACT

In an arrangement for monitoring the resistance between adjacent rail-ends of a section of railway track, the usual insulating end-post between the ends of adjacent rails is a molded component provided with an embedded conductive mesh or perforated plate situated roughly halfway between the rail-ends. The resistance between each rail-end and the conductive part is monitored to detect any significant decrease in resistance between either rail and the conductive part. When a sufficiently large resistance drop is detected, the normal track signaling circuits associated with the section of line involved are still able to function normally, since the insulation on the other side of the mesh is still unaffected at this stage. Railway personnel are now able to effect a repair to the affected part of the track at their (and the passengers') convenience before the whole end-post fails, disrupting normal service.

16 Claims, 2 Drawing Sheets

RESISTANCE-MONITORING ARRANGEMENT

BACKGROUND OF THE INVENTION

1. Field of the Invention

The invention relates to an arrangement for the monitoring of a resistance between adjacent rail-ends of a section of railway track, to a rail end-post for use in such an arrangement, and to a method for monitoring such a resistance.

2. Description of the Related Art

Railway tracks are conventionally divided into sections of track which are separated by an insulating member. The insulating member may be located between one rail of a section and the corresponding rail of the next section, or between both sets of rails of the two sections. Insulation is provided in order to enable the presence of a train on a particular track section to be detected. FIG. 1 shows a typical track signaling arrangement comprising three adjacent sections of track, namely sections n−1, n and n+1. The sections are insulated from each other on one rail 10 by so-called insulated block joints 12 and 13. The other rail 11 is, in this example, not provided with such block joints. Connected across the rails at one end of section n (similar arrangements apply to the other sections too, but are not shown) is a DC source 14 and a resistor 15. Across the rails at the other end of section n is a relay 16 whose contacts 17 are connected to suitable signaling circuits. When the track section n is clear, current I flows from the DC source 14 through the resistor 15, the rails 10 and 11 and through the relay 16, thereby operating the relay. Under these circumstances the signaling circuits give a "track clear" indication to the railway signaling system or to railway personnel. When, however, a train is situated on the section n, the axles and wheels of the train serve to provide a low-impedance shunting path for the current I so that the relay 16 de-energizes, thereby changing the signal from "track clear" to "track occupied". In some systems track signaling is effected by AC currents rather than DC.

The insulated block joints 12, 13 are normally constructed as in FIG. 2. In FIG. 2 it can be seen that two main items of insulation are provided: a so-called "end-post" 20 between the ends of the opposing rails 10*n* and 10*n*-1 and "skin" insulators 21 between the two adjacent rails and the fishplates 22 (only one is shown) which connect the rails. In addition, and not shown, insulating bushes are provided separating the fishplate bolts 23 from both the fishplates 22 and the rails 10*n*-1, 10*n*. (In an improved form of construction known as a "glued joint", the assembly described above is encapsulated in epoxy resin for extra strength.)

A common cause of track-signaling failure is a short-circuit failure of an insulated block joint which can cause the signaling circuit to show "occupied" instead of "clear". While this failsafe condition ensures the safety of the public and railway personnel traveling on the rolling stock, it does create unnecessary disruption to rail traffic so that throughput is needlessly reduced.

There are two potential short-circuit paths in an insulated block joint: firstly, a path via a single short-circuit from one rail-end to the next, adjacent, rail-end and, secondly, two simultaneous short-circuit paths from each of the two adjacent rails to the same fishplate. While it is known to monitor for short-circuits between the rails and the fishplate, there is a need to be able to predict a potential short-circuit (or low-impedance) between the rail-ends.

SUMMARY OF THE INVENTION

In accordance with a first aspect of the invention there is provided an end-post for the interfacing of adjacent rail-sections of a railway track, comprising an electrically insulating material having an electrically conductive laminar part disposed therein at an intermediate point between rail-interfacing ends thereof.

In particular, the electrically conductive part is disposed between two portions of the electrically insulating material, which insulating portions comprise rail-interfacing ends of the end-post.

It may be advantageous if the conductive part extends slightly beyond a profile of said insulating material over at least a part of the periphery of the end-post, this being for the purpose of providing an electrical contact means of detecting unwanted "creep" movement of the adjacent rail sections towards each other.

The two portions of insulating material may be formed separately and affixed to each other by way of said conductive part. However, alternatively and preferably, the end-post may be a molded component with said conductive part embedded in said molded component, the conductive part being incorporated in the end-post as an insert during the molding process. For this purpose, the conductive part may advantageously be a laminar perforate having a plurality of holes therethrough, the insulating material filling at least some of the holes therein such that the conductive part is thereby embedded in the insulating material and is inseparable therefrom except by disruption of the insulating material.

Alternatively stated, the preferred form of molded end-post for the interfacing of adjacent rail-sections of a railway track, comprises an electrically conductive part disposed between two portions of electrically insulating material, which insulating portions comprise rail-interfacing ends of the end-post, the conductive part being a laminar perforate having a plurality of holes therethrough such that the insulating portions are joined to each other through the holes and the conductive part is effectively embedded in the insulating material.

Preferably, the above-mentioned laminar perforate is a conductive mesh and the insulating material fills at least some of the holes in the mesh.

The conductive part is preferably disposed in the insulating mate rial approximately parallel to the rail-interfacing ends and approximately midway therebetween.

The conductive part may be provided with a peripheral extension for connection with external measurement circuitry.

The invention also provides a method of manufacturing a molded endpost constructed as described above, comprising the steps of holding the conductive part inside a mold cavity shaped to reproduce the external profile of the end-post, injecting the mold cavity with insulating material in a moldable state to achieve incorporation of the conductive part into the end-post, solidifying the insulating material by curing or cooling, and separating the end-post from the mold.

In accordance with a further aspect of the invention, a monitoring arrangement for the monitoring of a resistance between adjacent rail-ends of a section of railway track comprises a pair of adjacent rails, an end-post as described above disposed between opposing ends of said rails, and a resistance-measuring device connected to said conductive part and to at least one of said rails, whereby said resistance measuring device is arranged to provide an indication of an undesirably low resistance between a respective rail and said conductive part.

The resistance-measuring device may be connected to both rails such as provide said indication for both rails independently, or it may be connected to said both rails in a bridge configuration such as to provide an indication for both rails in combination. The resistance-measuring device may take the form of a computer-based monitoring system in which the resistance measurements are evaluated and compared with reference resistance values under the control of a software program. Such a program may also provide an indication of the derived resistance values.

In yet another aspect of the invention there is provided a method for monitoring a resistance state between adjacent rail-ends of a section of railway track, said rail-ends being separated by an insulating medium, the method comprising monitoring the resistance between respective said rail-ends and a conductive plane disposed in said insulating medium at an intermediate point between said rail-ends.

This method may include the further step of providing an indication of an undesirable decrease in at least one of said resistances, said indication serving to warn of a possibly impending short-circuit between said rail-ends.

BRIEF DESCRIPTION OF THE DRAWINGS

An embodiment of the invention will now be described, by way of example only, with reference to the drawings, of which:

FIG. 3(*b*) showing the effect of rail creep; and

DETAILED DESCRIPTION OF THE PREFERRED EMBODIMENT

Figure 3A:
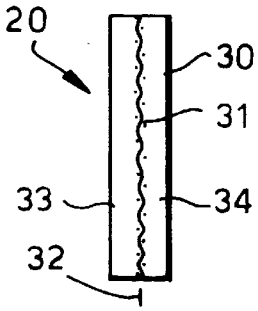
FIGS. 3(*a*) and (*b*) are side views of an end-post in accordance with the invention.
Figure 3B:
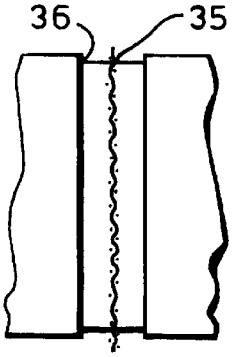

Referring now to FIG. 3(*a*), an end-post 20 according to the invention is shown in side elevation and comprises insulating material 30 and a conductive part 31 disposed in the insulating material, the conductive part being a laminar element. The conductive part is thin relative to the total thickness of the end-post between its rail-interfacing ends. For example, an end-post is typically between 10 and 20 mm thick between its rail-interfacing ends, and the conductive part may have a thickness of up to about 10% of the total end-post thickness.

The conductive part 31 generally does not protrude beyond the profile of the insulating material 30, except for a small extension 32 at one point of the conductive part to provide a connection point to external measuring equipment, and (preferably) a further small extension at the top edge (see later). The conductive part 31 is preferably situated halfway between the end faces of the insulating part.

The insulating material 30 may comprise two portions 33, 34, affixed to each other by way of the conductive part 31, the two insulating portions being the rail-interfacing ends of the end-post. However, it is preferred for ease and cheapness of manufacture, and ease and cheapness of fitting the end-post to the rail sections, that the end-post is a molded component, the conductive part being incorporated in the molded component during the molding process.

If the conductive part 31 is a molded component, the molding process is facilitated if the conductive part 31 is a laminar perforate and the insulating part 30 is molded so that it occupies at least some of the holes in the perforate, the insulation material and the conductive part then being one integral unit. The holes in the perforate should preferably be evenly distributed over its area and be sufficiently large and numerous to provide the end post 20, considered as an integral unit, with adequate strength and structural integrity for its demanding duty situated in a rail joint. In the preferred realization of the invention the conductive part 31 takes the form of a metal mesh, the insulating part 30 being molded so that it occupies the holes in the mesh. A possible material for the insulating part is a filled polymer, e.g., a nylon composition.

The techniques of injection molding of such polymers as nylon, with incorporation of metallic components in the mold to produce a finished composite metal/polymer component, are of course well known in the art of molding plastics and will not be described in detail. A method of manufacturing a molded end-post constructed as described above may be briefly summarized as follows:

1. Hold the conductive part in a mold cavity, the cavity being shaped to reproduce the external profile of the end-post. The mold will be assembled from two halves for reception of the conductive part as an insert in the mold and subsequent release of the molded component.

2. Inject the mold cavity with insulating material in a moldable condition to achieve incorporation of the conductive part into the end-post. Thermosetting materials are moldable as powders, while thermoplastic materials are moldable while in a hot plastic state.

3. Solidifying the molded insulating material by allowing it to set if it is a thermoplastic, or "curing" it, e.g., by heating, if it is a thermosetting material.

4. Remove the finished end-post from the mold by separating the two halves of the mold.

If, alternatively, the conductive part is sandwiched between two separate halves 33, 34 of the insulating material 30, these components may be secured together by any convenient means, e.g., by an adhesive. The essential criterion is that any fixing means used should not prejudice the insulative qualities of the insulating material 30. Where this "sandwich" alternative is employed, it is not necessary to use a mesh-type conductive part; rather, a continuous, plate-like element may be used instead, and may indeed under these conditions be preferable in mechanical terms to a mesh.

It is particularly advantageous if the conductive part 31 is arranged to protrude very slightly beyond the insulation profile on at least one edge of the end-post, particularly the top edge, so that if one of the rails should creep axially over the insulating part 30, it will eventually contact the conductive part and be signaled as a short-circuit (see later). FIG. 3(*b*) shows such a situation, reference designator 35 indicating the deliberate extension of the conductive part 31 and designator 36 the creeping (top) edge of one of the rails.

Figure 4A:
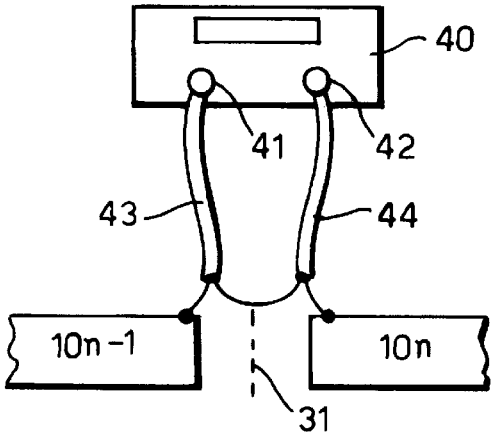
FIGS. 4(*a*), (*b*) and (*c*) are three alternative monitoring arrangements in accordance with the invention.
Figure 4B:
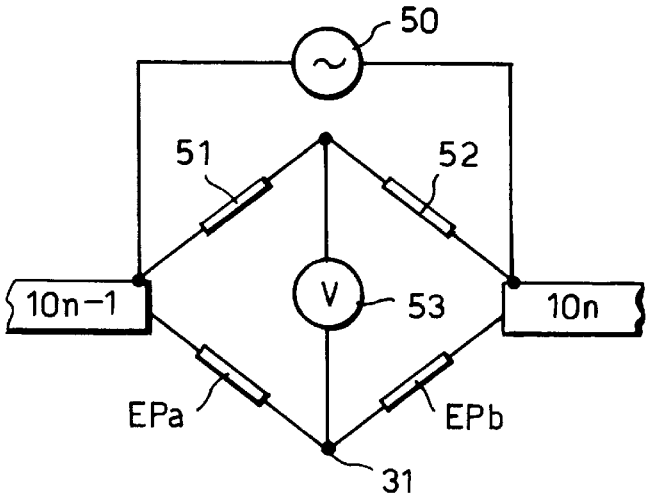
Figure 4C:
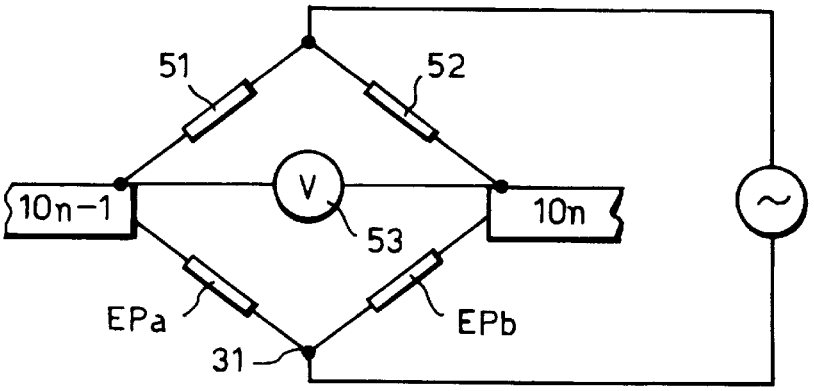

Signaling of undesirable low-resistance conditions in the end-post is effected by means of an appropriate resistance-measuring arrangement. A number of possible such measuring arrangements are shown in FIG. 4. FIG. 4(*a*) illustrates the use of a resistance meter having two independent inputs which are fed via two separate cables 43, 44 to respective rails 10*n*-1, 10*n*, one lead of each cable being taken to the conductive part 31 as a common connection. The meter 40 may then provide an indication either of both the associated resistances (10*n*-1-to-conductive part and 10*n*-to-conductive part) simultaneously, or of only one at a time, the particular resistance being displayed being selected by appropriate switching on the meter 40.

Alternatively, the meter 40 may have only one input, some kind of multiplexing device then being necessary between the meter and the cabling 41, 42.

Figure 1:
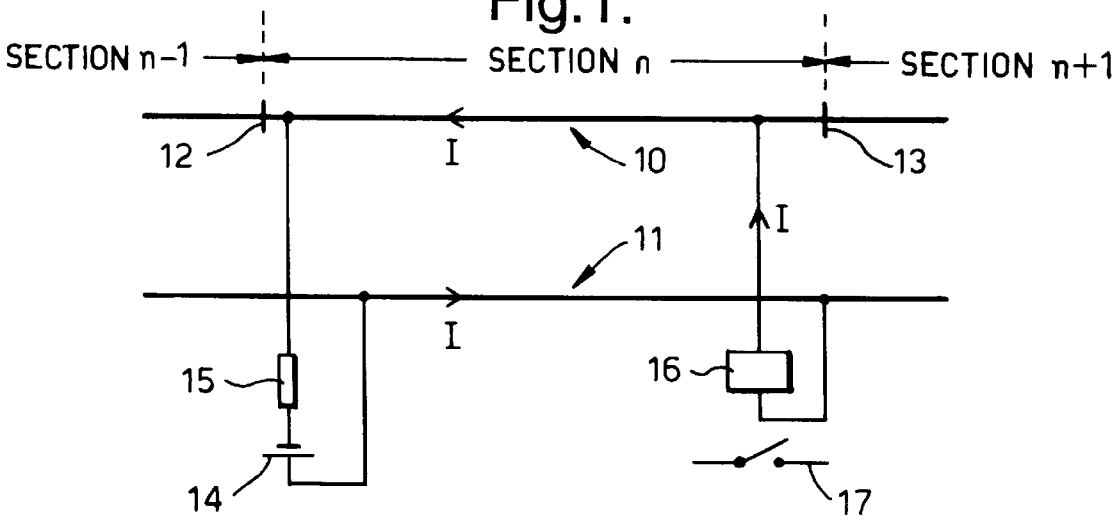
FIG. 1 is a schematic diagram of a known railway signaling track circuit according to the prior art.
Figure 2A:
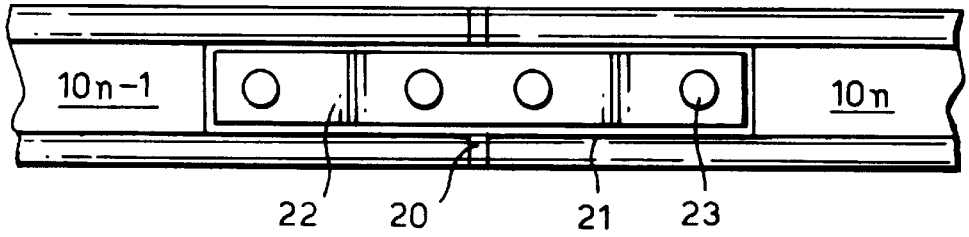
FIGS. 2(*a*) and (*b*) are side and plan views, respectively, of the interconnected rails of two adjacent track sections according to the prior art.
Figure 2B:
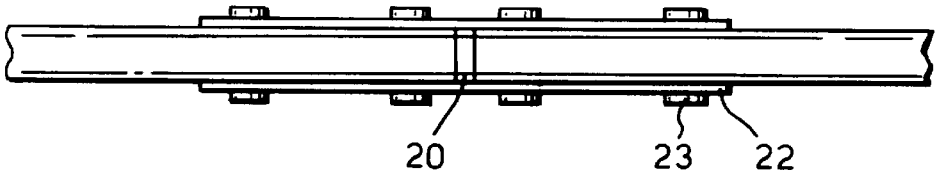

A second possible measuring arrangement is shown in FIG. 4(*b*), in which a bridge configuration is employed, whereby a measuring voltage source 50 is applied across the rails 10*n*-1 and 10*n*, a pair of resistors 51, 52 are connected in series across the same rails and a voltmeter 53 is connected between the mid-point of the resistor arrangement 51, 52 and the conductive part 31. Resistances EPa and EPb represent the respective resistances between the rail-ends and the conductive part. Where there is a possibility that the rails 10*n*-1 and 10*n* may be at different DC potentials (this will almost certainly be the case where DC track signaling is used, as shown in FIG. 1, and particularly where a train is present on an adjoining section of track), it may be necessary to couple one or more points of the bridge circuitry and voltage source 50 via capacitors so as to block any DC currents which might otherwise flow through the circuit, in particular the voltmeter 53.

With this bridge circuit, under normal conditions resistances EPa and EPb are substantially equal and therefore, if resistors 51, 52 are also chosen to be equal, voltmeter 53 will give a null reading. Where, however, one of the resistances EPa, EPb drops in value (e.g., due to rail creep), the bridge will be unbalanced and the voltmeter will show a finite reading, of a value depending on the degree of unbalance. It should be appreciated that, since EPa and EPb will normally have a very high value, the voltmeter 53 should itself have an extremely high input impedance.

The circuit of FIG. 4(*c*) is similar to that of FIG. 4(*b*), except that the bridge is arranged so that the voltmeter connection is taken from between the rails directly, and the voltage source is applied to the junction points of the two sets of resistances. The same comments regarding the possible need for capacitative coupling applies equally to this arrangement also.

Where AC track signaling is employed, it may be advisable to employ a DC voltage source 50 instead of an AC source as shown. In this case blocking inductors may be required in various points of the respective bridge circuits so that the AC track-signaling currents do not interfere with the DC rail-monitoring currents in the bridge. An advantage of using DC monitoring currents is that a center-zero voltmeter can be used to provide an indication of which side of the end-post has gone low-resistance. Thus, for example, if resistance EPa in FIG. 4(*b*) had assumed a low value (and, as already mentioned, the voltage source 50 were a DC source) and the resistors 51, 52 were nominally equal in value, then voltmeter 53 would show, say, a negative reading, whereas if resistance EPb had assumed a low value, the voltmeter would show a positive reading.

In a practical measurement set-up the measurement of resistance may be carried out by a computer-based monitoring system which may already be in place for the purpose of effecting other system measurements. Such a monitoring system will generally be operated under software control which will initiate resistance measurement per se, compare these measurements with reference (i.e., threshold) values and, where such threshold values are undershot, normally provide some kind of indication of an undesirably low resistance value.

The mesh or plate, as appropriate, may be made of any suitable conductive material, though a common metal may be the best option in terms of both electrical performance and economics. In particular, care should be taken to ensure that this component will not rust in use; stainless steel is for this reason a preferred material.

It can be seen that, by the use of an embedded conductive element in an insulating end-post, the invention enables partial failure of the insulation to be detected before it affects the whole end-post, the result being that the track circuits can still operate normally and the rail service remains unaffected. Remedial action on the part of the track affected can then be undertaken when convenient before complete failure occurs.

While it has been assumed that the mesh (or plate) will be centrally located in the end-post, it may be disposed off-center. The disadvantage of this, however, is that the sensitivity of measurement of resistance on opposite sides of the conductive part will be unequal. For this reason a central location of the conductive part is preferred.

I claim:

1. An end-post for the interfacing of adjacent rail-sections of a railway track, comprising: an electrically insulating material having an electrically conductive laminar part located therein at an intermediate point between rail-interfacing ends thereof, the conductive part being a laminar perforate embedded in the electrically insulating material.

2. The end-post as claimed in claim 1, wherein the conductive part extends beyond a profile of the insulating material over at least a part of a periphery of the end-post.

3. An end-post for the interfacing of adjacent rail-sections of a railway track, comprising: an electrically conductive part disposed between two portions of electrically insulating material, the insulating portions comprising rail-interfacing ends of the end-post, the conductive part being a laminar perforate which extends beyond a profile of said insulating portions at a top edge of the profile of the end-post.

4. The end-post as claimed in claim 3, wherein the end-post is a molded component, the conductive part being incorporated in the end-post during the molding process.

5. The end-post as claimed in claim 4, wherein the laminar perforate has a plurality of holes therethrough, the insulating material filling at least some of the holes therein such that the conductive part is thereby embedded in the insulating material and is inseparable therefrom except by disruption of the insulating material.

6. The end-post as claimed in claim 5, wherein the laminar perforate is a conductive mesh and wherein the insulating material fills at least some of the holes in the mesh.

7. The end-post as claimed in claim 3, wherein the conductive part is disposed approximately mid-way between the rail-interfacing ends of the end-post.

8. The end-post as claimed in claim 3, wherein the conductive part is provided with a peripheral extension adapted for connection to external measurement circuitry.

9. Monitoring arrangement for the monitoring of a resistance between adjacent rail-ends of a section of railway track, comprising: a pair of adjacent rails; an end-post disposed between opposing ends of said rails, the end post comprising an electrically insulating material having an electrically conductive laminar part located therein at an intermediate point between rail-interfacing ends thereof, the conductive part being a laminar perforate embedded in the electrically insulating material; and a resistance-measuring device connected to the conductive part and to at least one of said rails, the resistance measuring device being arranged to provide an indication of an undesirably low resistance between a respective rail and said conductive part.

10. Monitoring arrangement as claimed in claim 9, wherein the resistance-measuring device is connected to both rails such as provide said indication for both rails independently.

11. Monitoring arrangement as claimed in claim 9, wherein the resistance-measuring device is connected to said both rails in a bridge configuration such as to provide an indication for both rails in combination.

12. Monitoring arrangement as claimed in claim 9, wherein the resistance-measuring device is a computer-based monitoring system for evaluating and comparing the resistance measurements with reference resistance values under the control of a software program.

13. Monitoring arrangement as claimed in claim 12, wherein the resistance measurements are indicated under said software-program control.

14. Method of monitoring a resistance state between adjacent rail-ends of a section of railway track, said rail-ends being separated by an insulating medium, the method comprising the step of: monitoring the resistances between respective said rail-ends and a conductive laminar perforate embedded in said insulating medium at an intermediate point between said rail-ends.

15. Method as claimed in claim 14; and further comprising the step of providing an indication of an undesirable decrease in at least one of said resistances, said indication serving to warn of a possibly impending short-circuit between said rail-ends.

16. A method of manufacturing a molded end-post for interfacing railway track sections, comprising the steps of: holding an electrically conductive laminar perforate inside a mold cavity shaped to reproduce an external profile of the end-post; injecting the mold cavity with electrically insulating material in a moldable state to achieve incorporation of the conductive perforate into the end-post; solidifying the insulating material; and separating the end-post from the mold.

* * * * *